US010022592B2

(12) United States Patent
Madson et al.

(10) Patent No.: US 10,022,592 B2
(45) Date of Patent: Jul. 17, 2018

(54) DIMPLE PATTERNS FOR GOLF BALLS

(71) Applicant: Acushnet Company, Fairhaven, MA (US)

(72) Inventors: Michael R. Madson, Easton, MA (US); Nicholas M. Nardacci, Barrington, RI (US); Chris Hixenbaugh, Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 15/431,838

(22) Filed: Feb. 14, 2017

(65) Prior Publication Data

US 2017/0151466 A1 Jun. 1, 2017

Related U.S. Application Data

(63) Continuation of application No. 14/144,483, filed on Dec. 30, 2013, now Pat. No. 9,566,473.

(51) Int. Cl.
*A63B 37/00* (2006.01)

(52) U.S. Cl.
CPC ..... *A63B 37/0006* (2013.01)

(58) Field of Classification Search
CPC ..... A63B 37/0006
See application file for complete search history.

(56) References Cited

U.S. PATENT DOCUMENTS

| | | | | |
|---|---|---|---|---|
| 4,720,111 | A | 1/1988 | Yamada | |
| 4,915,389 | A | 4/1990 | Ihara | |
| 5,145,180 | A | 9/1992 | Oka | |
| 5,156,404 | A | 10/1992 | Oka | |
| 5,415,410 | A | 5/1995 | Aoyama | |
| 5,544,890 | A | 8/1996 | Shaw | |
| 5,564,708 | A | 10/1996 | Hwang | |
| 5,735,756 | A | 4/1998 | Stiefel | |
| 5,890,974 | A * | 4/1999 | Stiefel | A63B 37/0004 473/384 |
| 5,957,786 | A | 9/1999 | Aoyama | |
| 6,206,792 | B1 | 3/2001 | Tavares | |
| 6,530,850 | B2 | 3/2003 | Sajima | |
| 6,540,625 | B2 | 4/2003 | Sajima | |
| 6,616,553 | B1 | 9/2003 | Tavares | |
| 6,663,511 | B2 | 12/2003 | Sullivan | |
| 6,688,993 | B2 | 2/2004 | Sajima | |
| 6,726,579 | B2 | 4/2004 | Ohama | |
| 6,729,976 | B2 | 5/2004 | Bissonnette | |
| 6,969,327 | B2 | 11/2005 | Aoyama | |
| 7,201,674 | B2 | 4/2007 | Ohama | |
| 7,278,932 | B2 | 10/2007 | Kasashima | |
| 7,503,856 | B2 | 3/2009 | Nardacci et al. | |
| 7,594,867 | B2 | 9/2009 | Nardacci | |
| 8,747,256 | B2 | 6/2014 | Fitchett | |
| 2003/0134695 | A1 * | 7/2003 | Kasashima | A63B 37/0004 473/378 |
| 2005/0032590 | A1 * | 2/2005 | Kasashima | A63B 37/0004 473/378 |

(Continued)

*Primary Examiner* — John E Simms, Jr.
(74) *Attorney, Agent, or Firm* — Mandi B. Milbank

(57) ABSTRACT

The present invention provides a golf ball wherein each hemisphere has a dimple pattern based on a pyramid having dissimilar sides. The resulting overall dimple pattern is not based on preexisting polyhedral, and is not attainable using conventional dimple packing methods.

4 Claims, 12 Drawing Sheets

(56) References Cited

U.S. PATENT DOCUMENTS

| | | | | |
|---|---|---|---|---|
| 2007/0049423 | A1 | 3/2007 | Nardacci | |
| 2010/0075776 | A1* | 3/2010 | Nardacci | A63B 37/0039 473/371 |
| 2012/0004053 | A1 | 1/2012 | Kim | |
| 2012/0015761 | A1* | 1/2012 | Madson | A63B 37/0006 473/379 |
| 2012/0046131 | A1* | 2/2012 | Fitchett | A63B 37/0004 473/384 |
| 2013/0072325 | A1 | 3/2013 | Madson et al. | |

* cited by examiner

DIMPLE PATTERNS FOR GOLF BALLS

CROSS REFERENCE TO RELATED APPLICATIONS

The present application is a continuation of U.S. patent application Ser. No. 14/144,483, filed Dec. 30, 2013, the entire disclosure of which is hereby incorporated herein by reference.

FIELD OF THE INVENTION

This invention relates to golf balls having two hemispheres, each hemisphere having a dimple pattern based on a pyramid having dissimilar sides.

BACKGROUND OF THE INVENTION

U.S. Patent Application Publication No. 2013/0072325 to Madson et al. discloses a golf ball dimple pattern having an underlying geometry based on a dipyramid.

U.S. Pat. No. 7,503,856 to Nardacci et al. discloses a golf ball dimple pattern based on a hexagonal dipyramid, wherein the dimples are arranged in six substantially similar mating dimple sections on each hemisphere.

U.S. Patent Application Publication No. 2012/0004053 to Kim discloses a designing method for a dimple pattern of a golf ball including the steps of (1) dividing a surface of a phantom sphere of the golf ball into a plurality of units by division lines obtained by projecting edge lines of a regular polyhedron inscribed in the phantom sphere, on the surface of the phantom sphere; (2) obtaining a base pattern by randomly arranging a plurality of dimples in one unit such that the dimples do not overlap each other; and (3) developing the base pattern over other units such that patterns of two adjacent units are not mirror-symmetrical to each other.

SUMMARY OF THE INVENTION

In one embodiment, the present invention is directed to a golf ball having a first hemisphere and a second hemisphere separated by an equator, each hemisphere comprising on the outer surface thereof, a plurality of dimples arranged in a pattern defined by an n-sided pyramid projected on a hemisphere as n lines of longitude from pole to equator. The dimple arrangement along each longitudinal line is identical, and the overall dimple pattern on each hemisphere contains no rotational symmetry about the polar axis.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION

Golf balls of the present invention include a first pole, a second pole opposite the first pole, and an equator evenly spaced between the first and second poles so as to divide the golf ball into a first hemisphere including the first pole and a second hemisphere including the second pole. The outer surface of each hemisphere includes a plurality of dimples arranged in a pattern defined by an n-sided pyramid projected on a hemisphere as n lines of longitude from pole to equator, wherein n≥3. At least two of the sides of the pyramid are dissimilar. For purposes of the present invention, one side of the pyramid is dissimilar to another side of the pyramid if they have a different longitudinal angle, $\phi_i$, and a different arrangement of dimples. When combined, the longitudinal angles of each hemisphere sum to 360. For a hemisphere having m dissimilar sides, and $r_i$ repetitions of each side:

$$\sum_{i=1}^{m} r_i \phi_i = 360. \quad \text{(Equation 1)}$$

The total number of distinct hemispheres that can be created, τ, is calculated as the number of circular permutations:

$$\tau = \frac{(n-1)!}{r_1! \times r_2! \times \ldots \times r_m!}, \quad \text{(Equation 2)}$$

where n, the total number of sides for a hemisphere, is:

$$n = \sum_{i=1}^{m} r_i. \quad \text{(Equation 3)}$$

In a particular embodiment, the first hemisphere and the second hemisphere have the same number of sides. In a particular aspect of this embodiment, the dimple arrangement of the first hemisphere and the dimple arrangement of the second hemisphere are the same. In another particular aspect of this embodiment, the dimple arrangement of the first hemisphere and the dimple arrangement of the second hemisphere are different.

In another particular embodiment, the first hemisphere and the second hemisphere have a different number of sides.

Each dimple is either located entirely within a single side of the pyramid or is intersected by a side edge of the pyramid such that the center of the dimple lies on the same plane as the side edge, i.e., a longitudinal line. In a particular embodiment, the dimple arrangement along each longitudinal line of a hemisphere is identical, meaning that each dimple that is located along a side edge of the pyramid is replicated on all side edges of the pyramid. For purposes of the present invention, a dimple on one edge is a replicate of a dimple on another edge if the dimples have the same latitudinal angle and diameter. By way of definition, if such a dimple arrangement is repeated on multiple longitudinal lines, then those lines define the edges of the segments. If more than one such a dimple arrangement exists then the segments edges are defined by the arrangement that produces the greatest number of segments on the ball. If more than one such a dimple arrangement exists and they produce the same number of segments, then any one arrangement can be used to define the edges of the segment, but not more than one.

Figure 1:
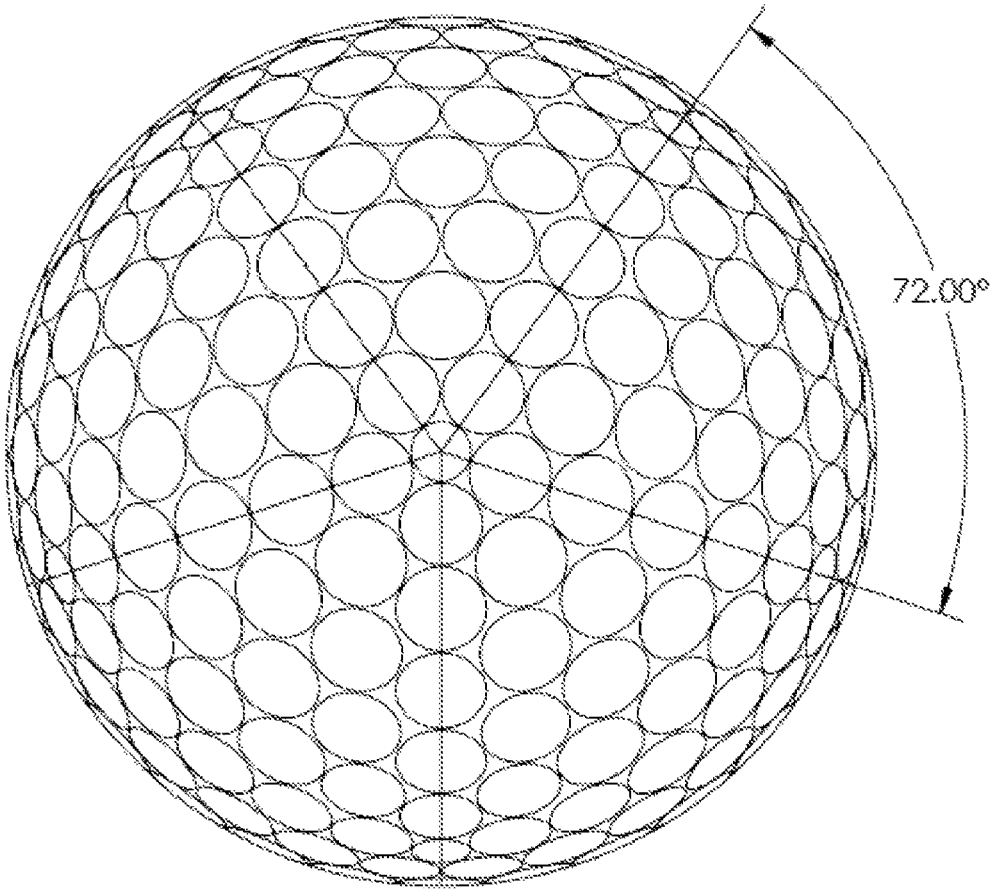
FIG. 1 is a polar view of a golf ball having a dimple pattern arranged according to a method known in the art.
Figure 2:
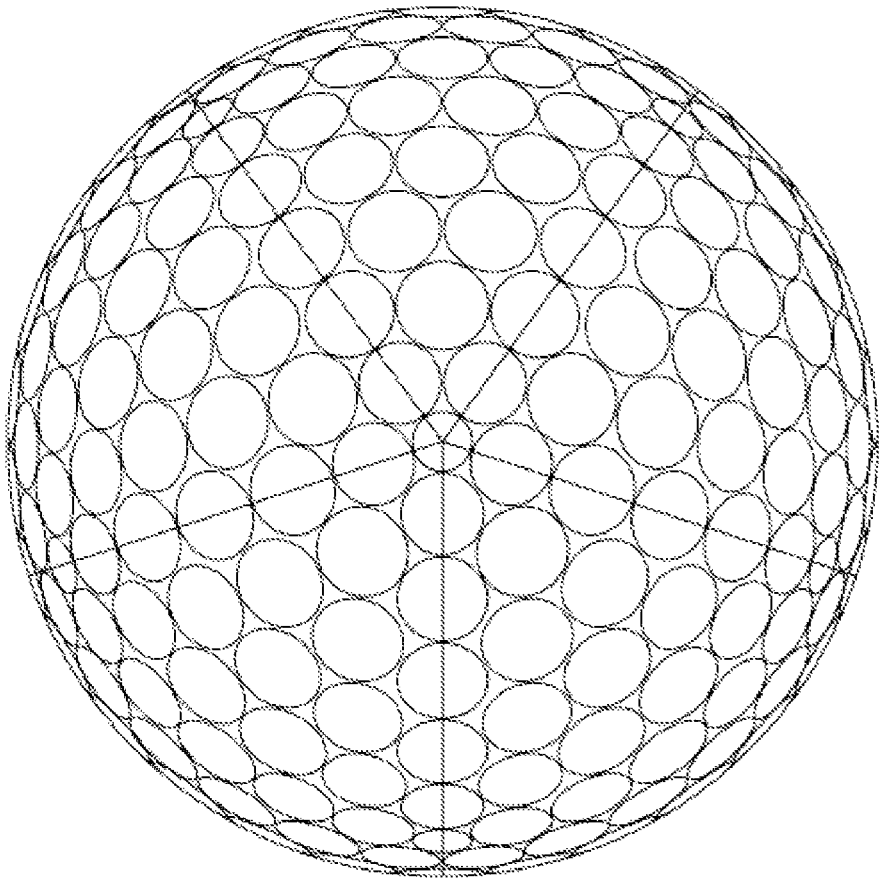
FIG. 2 is a polar view of the golf ball of FIG. 1 rotated 72° about the polar axis.

In a particular embodiment, the overall dimple pattern on each hemisphere does not have rotational symmetry about the polar axis. The polar axis is defined herein as the axis connecting the pole of the first hemisphere to the pole of the second hemisphere. Rotational symmetry is said to exist if a hemisphere can be rotated by any angle and result in an identical pattern, as with conventional golf ball dimple patterns. FIG. 1 is a polar view of a golf ball having a dimple pattern with rotational symmetry. When rotated 72° about the polar axis, the resulting pattern, shown in FIG. 2, is identical to the original pattern. A pattern is said to have x-fold rotational symmetry on a given hemisphere if any rotational angle γ about the polar axis exists such that $$\frac{360}{\gamma} = x,$$

and x is a whole number ≥2. Thus, the pattern shown in FIGS. 1 and 2 has 5-fold rotational symmetry $$\left(\frac{360}{72} = 5\right).$$

Figure 3:
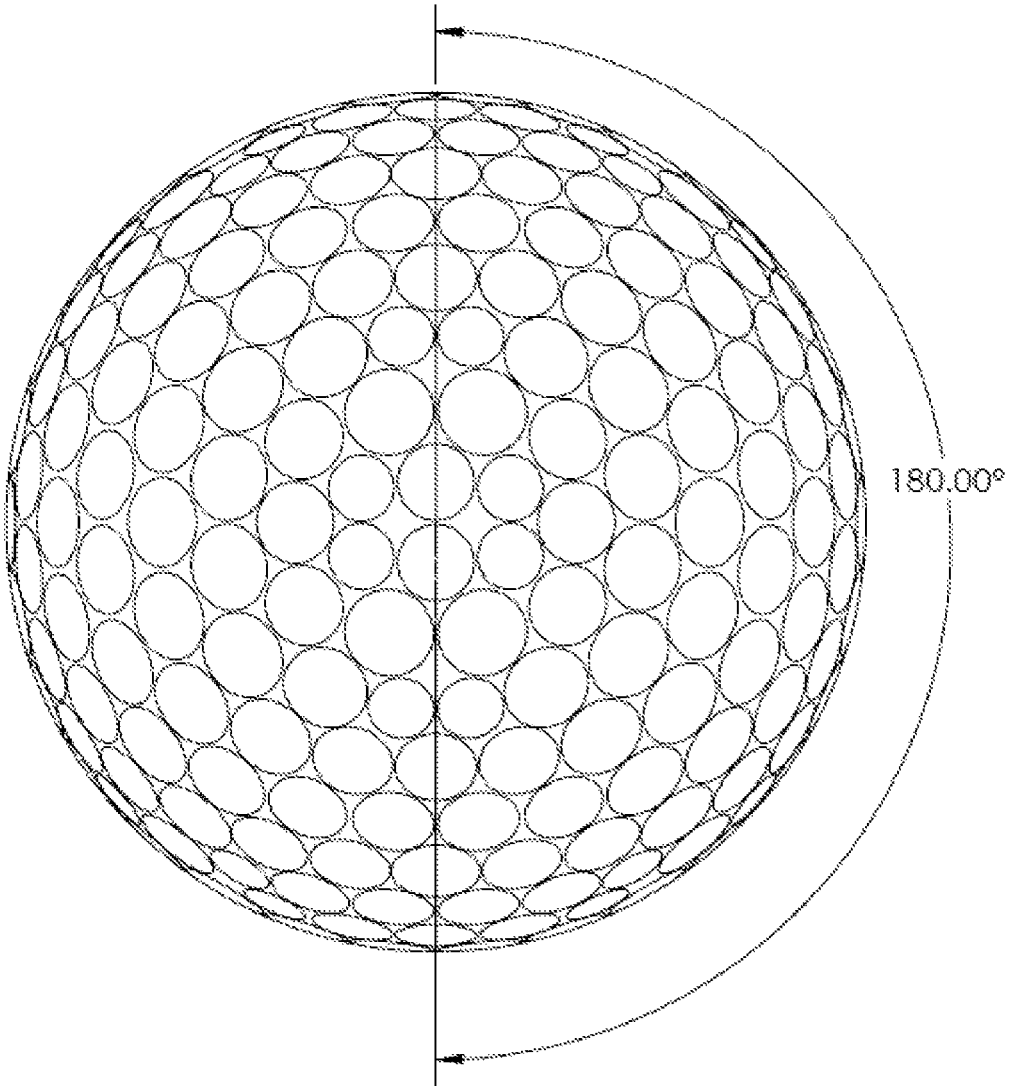
FIG. 3 is a polar view of a golf ball having a dimple pattern arranged according to a method known in the art.
Figure 4:
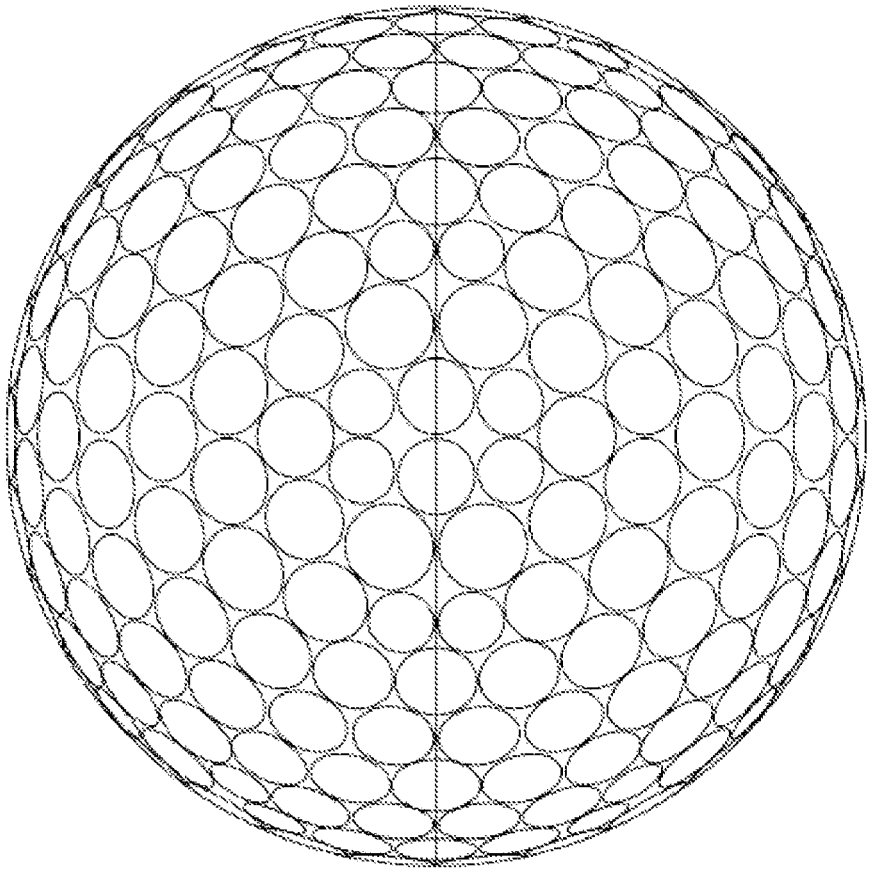
FIG. 4 is a polar view of the golf ball of FIG. 3 rotated 180° about the polar axis.

FIG. 3 is a polar view of another golf ball having a dimple pattern with rotational symmetry. When rotated 180° about the polar axis, the resulting pattern, shown in FIG. 4, is identical to the original pattern. Thus, the pattern shown in FIGS. 3 and 4 has 2-fold rotational symmetry $$\left(\frac{360}{180} = 2\right).$$

The two hemispheres can be positioned in any manner such that the dimples from one hemisphere do not intersect with dimples from the other hemisphere. In one embodiment, the two hemispheres are mirror images of each other and the ball has a flat, i.e., planar, parting line. In another embodiment, the two hemispheres have an angular rotation relative to one another and create a flat parting line. In another embodiment, the two hemispheres have an angular rotation relative to one another and create a staggered, i.e., non-planar, parting line, such that the dimples near the equator are allowed to cross over the ball equator but do not intersect dimples from the opposing hemisphere.

While preferably having a substantially circular plan shape, dimples of the present invention are not limited to a particular plan or cross-sectional shape.

Dimples of the present invention may have different properties including, but not limited to, cross-sectional shape, plan shape, diameter, and depth. In a particular embodiment, replicated dimples have the same cross-sectional shape and plan shape.

While golf balls of the present invention are not limited to a particular dimple count, in a particular embodiment, the golf ball has a dimple count of 336 or 338 or 342 or 344 or 349 or 350 or 310 or 316 or 318 or 346 or 354 or 358 or 366.

EXAMPLES

The examples below are for illustrative purposes only. In no manner is the present invention limited to the specific disclosures therein.

Example 1

Figure 5:
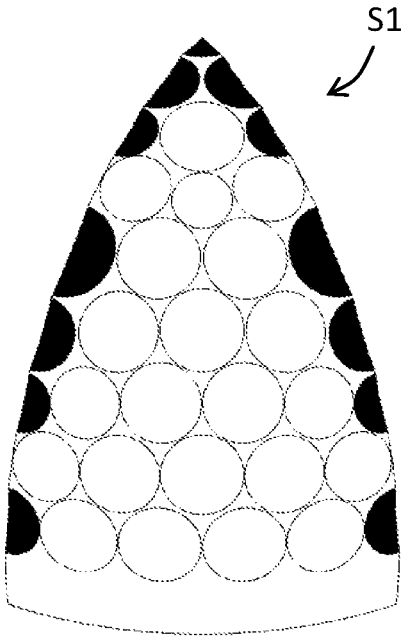
FIG. 5 illustrates a side of a pyramid projected on a hemisphere and packed with dimples.
Figure 6:
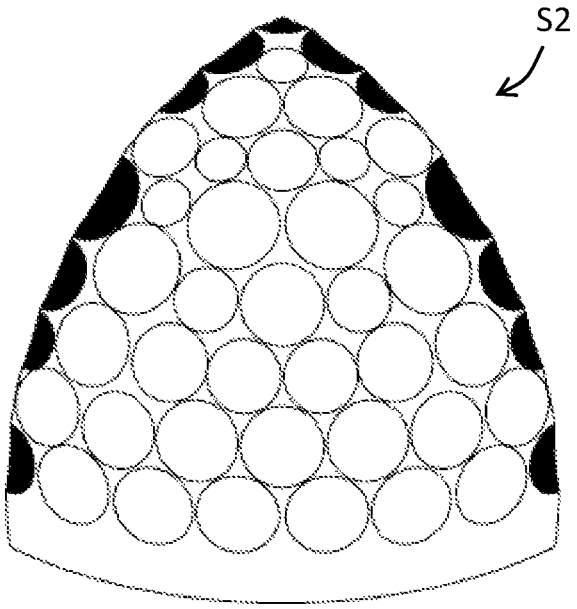
FIG. 6 illustrates a side of a pyramid projected on a hemisphere and packed with dimples.

As shown in FIG. 5, a first side, S1, of a pyramid is projected on a hemisphere and packed with dimples. The first side has a longitudinal angle of 60°. As shown in FIG. 6, a second side, S2, of a pyramid is projected on a hemisphere and packed with dimples in a different arrangement than S1. The second side has a longitudinal angle of 90°. Dimples that intersect the side edges are shaded in FIGS. 5 and 6. Dissimilar sides S1 and S2 can be combined and repeated to form an overall dimple pattern of a golf ball hemisphere having the characteristics given in Table 1 below.

TABLE 1

| Dissimilar Segments, m | Repetitions, $r_i$ | Longitudinal Angle, $\phi_\varepsilon$ |
|---|---|---|
| S1 | 3 | 60° |
| S2 | 2 | 90° |

Using Equation 3, the total number of sides for the hemisphere, n, is 5. The total number of distinct hemispheres, τ, that can be created is 2, as calculated using Equation 2, $$\tau = \frac{(5-1)!}{2! \times 3!} = 2.$$

Figure 7:
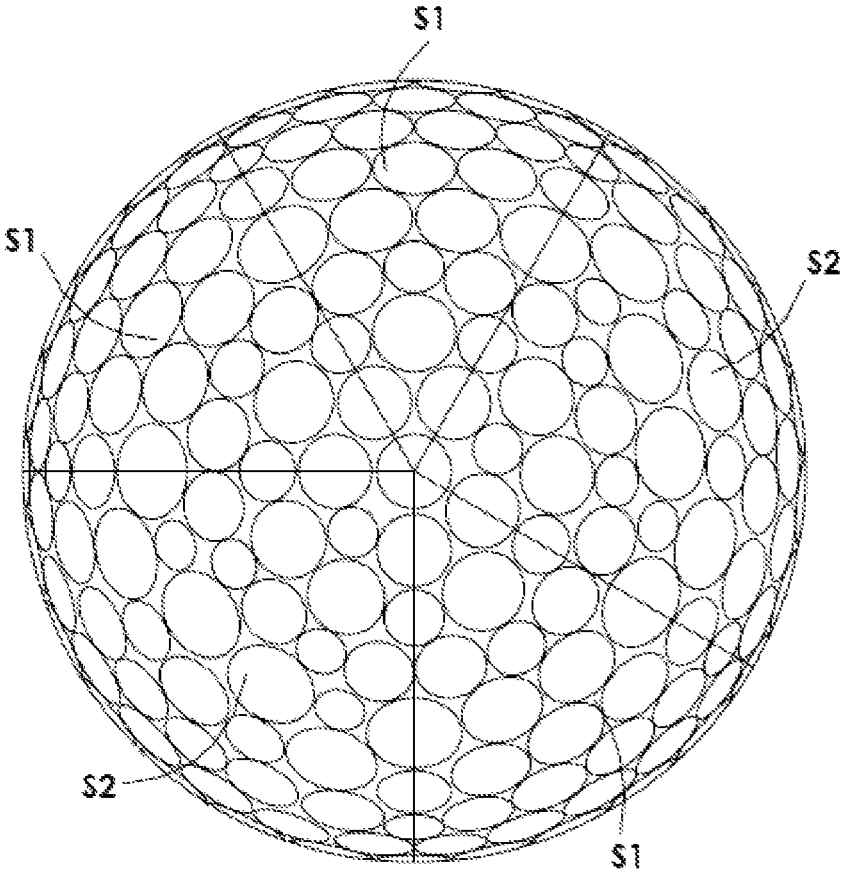
FIG. 7 is a polar view of a golf ball having dimples arranged according to an embodiment of the present invention.
Figure 8:
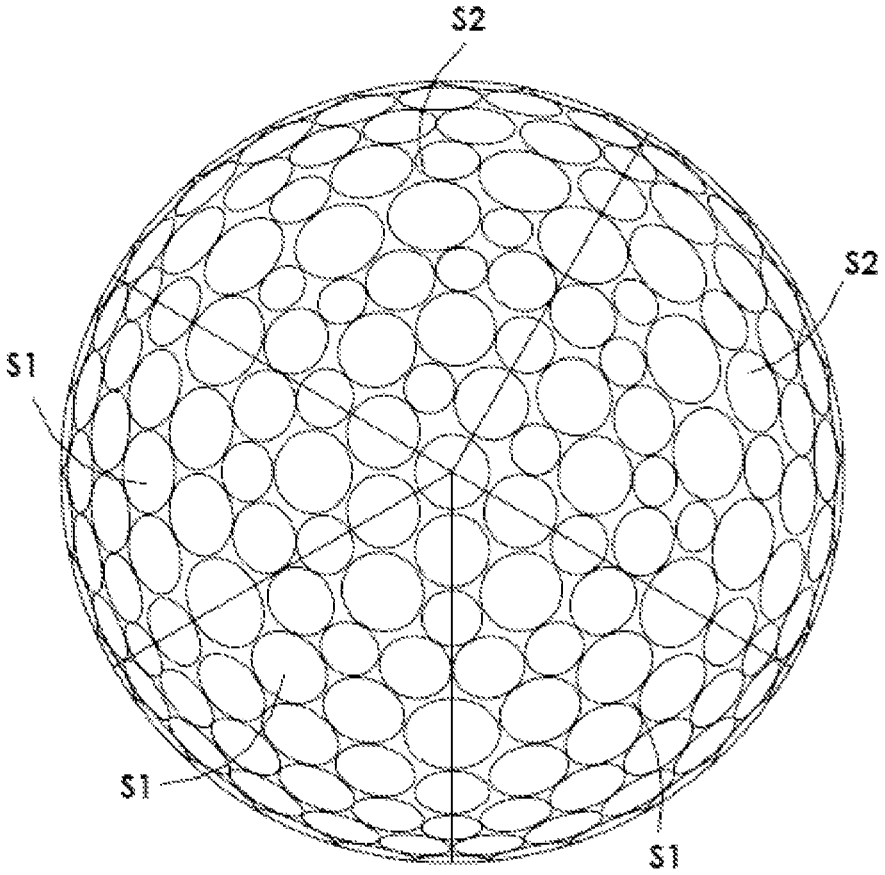
FIG. 8 is a polar view of a golf ball having dimples arranged according to an embodiment of the present invention.

The two distinct hemispheres that can be created are shown in FIGS. 7 and 8. FIG. 7 illustrates a hemisphere with a rotational pattern of {S1,S2,S1,S2,S1}. FIG. 8 illustrates a hemisphere with a rotational pattern of {S2,S2,S1,S1,S1}.

Example 2

Figure 9:
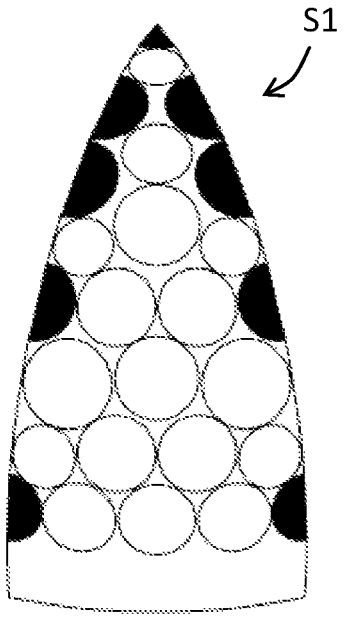
FIG. 9 illustrates a side of a pyramid projected on a hemisphere and packed with dimples.

As shown in FIG. 9, a first side, S1, of a pyramid is projected on a hemisphere and packed with dimples. The first side has a longitudinal angle of 45°. As shown in FIG.

Figure 10:
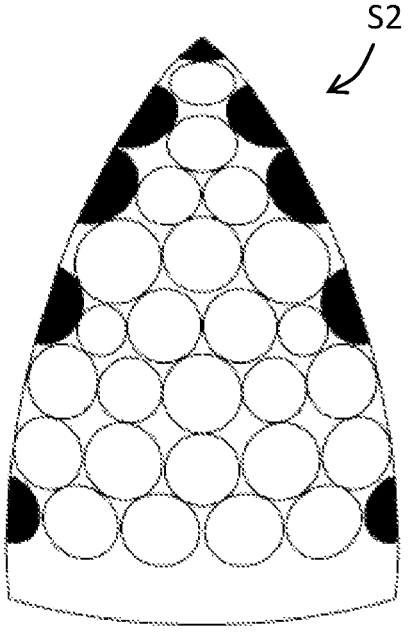
FIG. 10 illustrates a side of a pyramid projected on a hemisphere and packed with dimples.

10, a second side, S2, of a pyramid is projected on a hemisphere and packed with dimples in a different arrangement than S1. The second side has a longitudinal angle of 60°. Dimples that intersect the side edges are shaded in FIGS. 9 and 10. Dissimilar sides S1 and S2 can be combined and repeated to form an overall dimple pattern of a golf ball hemisphere having the characteristics given in Table 2 below.

TABLE 2

| Dissimilar Segments, m | Repetitions, $r_i$ | Longitudinal Angle, $\phi_\varepsilon$ |
|---|---|---|
| S1 | 4 | 45° |
| S2 | 3 | 60° |

Using Equation 3, the total number of sides for the hemisphere, n, is 7. The total number of distinct hemispheres, τ, that can be created is 5, as calculated using Equation 2, $$\tau = \frac{(7-1)!}{4! \times 3!} = 5.$$

Figure 11:
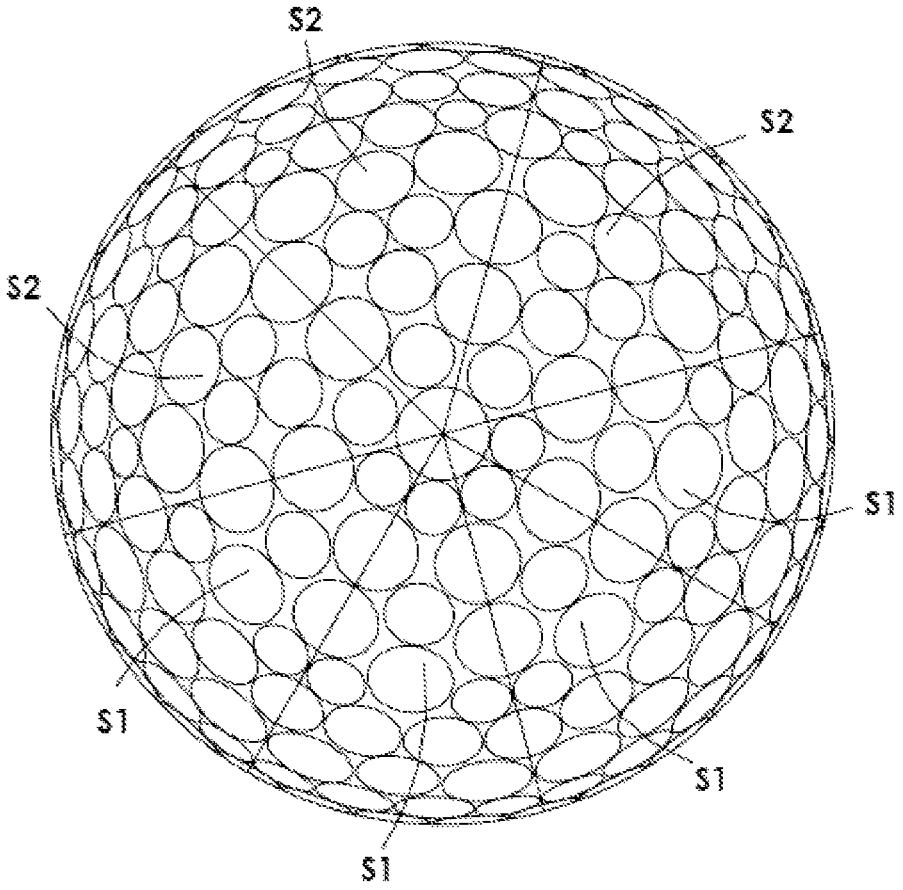
FIG. 11 is a polar view of a golf ball having dimples arranged according to an embodiment of the present invention.
Figure 12:
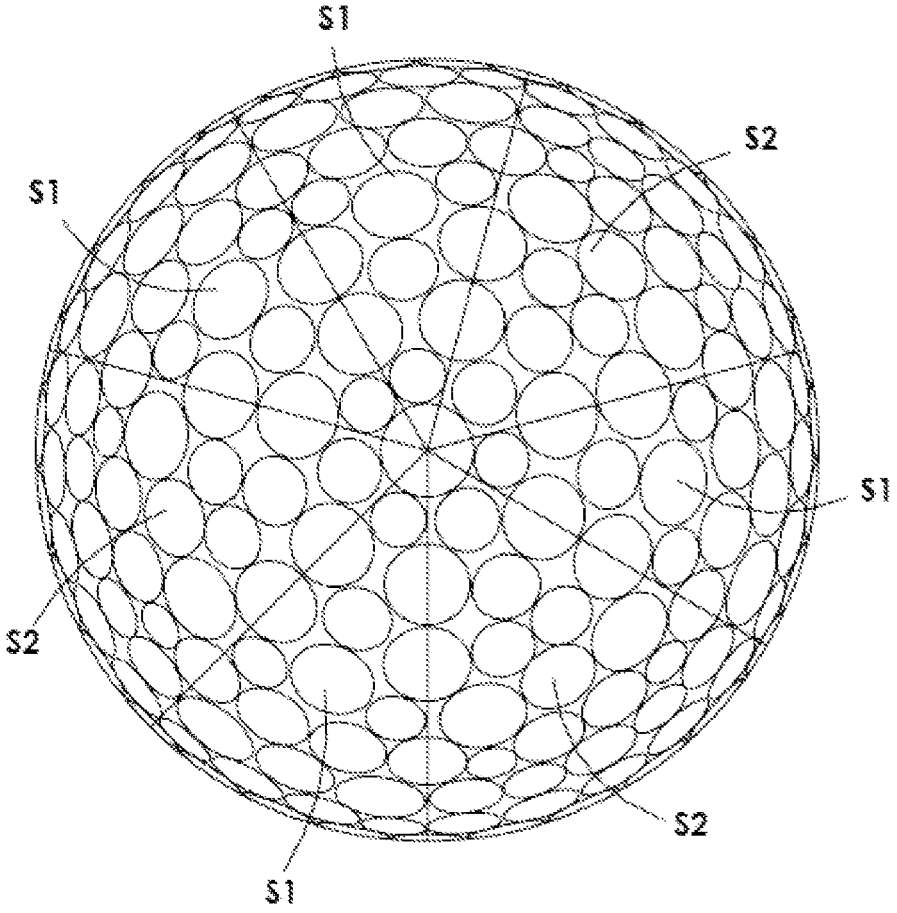
FIG. 12 is a polar view of a golf ball having dimples arranged according to an embodiment of the present invention.

Two of the five distinct hemispheres that can be created are shown in FIGS. 11 and 12. FIG. 11 illustrates a hemisphere with a rotational pattern of {S1,S1,S1,S2,S2,S2,S2}. FIG. 12 illustrates a hemisphere with a rotational pattern of {S1,S1,S2,S1,S2,S1,S2}.

Example 3

Figure 13:
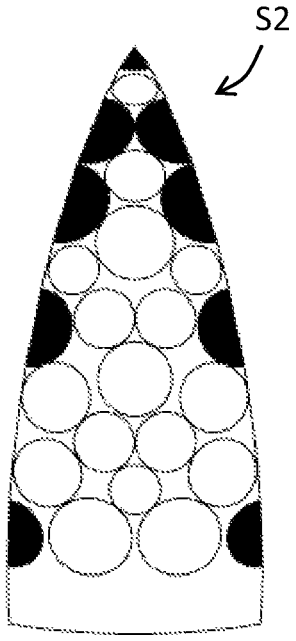
FIG. 13 illustrates a side of a pyramid projected on a hemisphere and packed with dimples.
Figure 14:
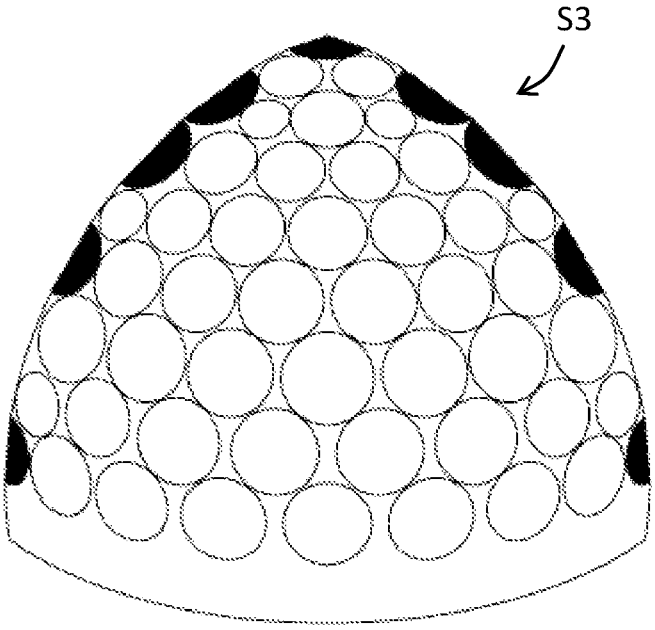
FIG. 14 illustrates a side of a pyramid projected on a hemisphere and packed with dimples.

As shown in FIG. 9, a first side, S1, of a pyramid is projected on a hemisphere and packed with dimples. The first side has a longitudinal angle of 45°. As shown in FIG. 13, a second side, S2, of a pyramid is projected on a hemisphere and packed with dimples in a different arrangement than S1. The second side has a longitudinal angle of 38°. As shown in FIG. 14, a third side, S3, of a pyramid is projected on a hemisphere and packed with dimples in a different arrangement than S1 or S2. The third side has a longitudinal angle of 111°. Dimples that intersect the side edges are shaded in FIGS. 9, 13 and 14. Dissimilar sides S1, S2 and S3 can be combined and repeated to form an overall dimple pattern of a golf ball hemisphere having the characteristics given in Table 3 below.

TABLE 3

| Dissimilar Segments, m | Repetitions, $r_i$ | Longitudinal Angle, $\phi_\varepsilon$ |
|---|---|---|
| S1 | 3 | 45° |
| S2 | 3 | 38° |
| S3 | 1 | 111° |

Using Equation 3, the total number of sides for the hemisphere, n, is 7. The total number of distinct hemispheres, τ, that can be created is 20, as calculated using Equation 2, $$\tau = \frac{(7-1)!}{3! \times 3! \times 1!} = 20.$$

Figure 15:
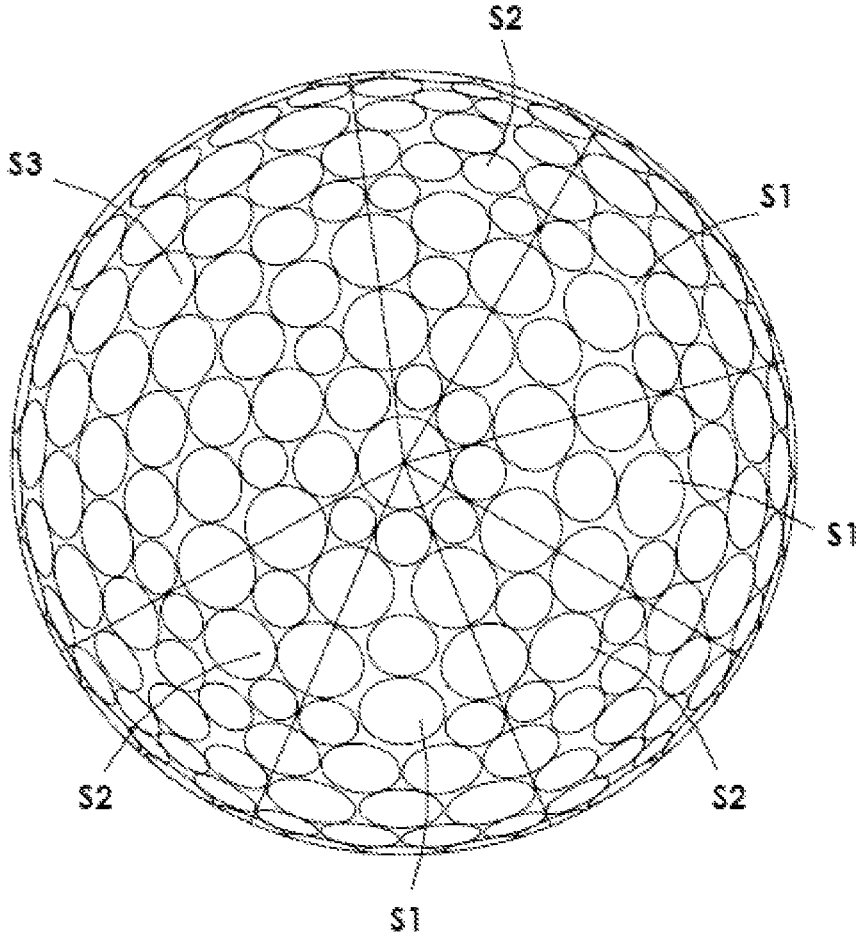
FIG. 15 is a polar view of a golf ball having dimples arranged according to an embodiment of the present invention.

One of the twenty distinct hemispheres that can be created is shown in FIG. 15, which illustrates a hemisphere with a rotational pattern of {S2,S1,S1,S2,S1,S2,S3}.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having a first hemisphere and a second hemisphere separated by an equator, each hemisphere comprising on the outer surface thereof a plurality of dimples arranged in a pattern defined by an n-sided pyramid projected on a hemisphere, the edges of the pyramid representing n lines of longitude from pole to equator, wherein the dimple arrangement along each of the n longitudinal lines is identical, wherein the pattern is not rotationally symmetric about the polar axis, and wherein the number of sides on the first hemisphere is different from the number of sides on the second hemisphere.

2. A golf ball having a first hemisphere and a second hemisphere separated by an equator, each hemisphere comprising on the outer surface thereof a plurality of dimples arranged in a pattern defined by an n-sided pyramid projected on a hemisphere, the edges of the pyramid representing n lines of longitude from pole to equator, wherein the dimple arrangement along each of the n longitudinal lines is identical, wherein the pattern is not rotationally symmetric about the polar axis, and wherein at least two of the sides of one hemisphere have a different longitudinal angle.

3. The golf ball of claim 2, wherein the golf ball has a flat parting line along the equator.

4. The golf ball of claim 2, wherein the golf ball has a staggered parting line along the equator.

* * * * *